US011982487B2

(12) United States Patent
Jing et al.

(10) Patent No.: US 11,982,487 B2
(45) Date of Patent: May 14, 2024

(54) DEFROSTING CONTROL METHOD, CENTRAL CONTROLLER AND HEATING SYSTEM

(71) Applicant: A. O. SMITH (CHINA) WATER HEATER CO., LTD., Nanjing (CN)

(72) Inventors: Yufeng Jing, Nanjing (CN); Fei Liu, Nanjing (CN); Miao Chen, Nanjing (CN)

(73) Assignee: A.O. SMITH CORPORATION, Milwaukee, WI (US)

( * ) Notice: Subject to any disclaimer, the term of this patent is extended or adjusted under 35 U.S.C. 154(b) by 145 days.

(21) Appl. No.: 17/589,282

(22) Filed: Jan. 31, 2022

(65) Prior Publication Data

US 2022/0252326 A1 Aug. 11, 2022

(30) Foreign Application Priority Data

Feb. 8, 2021 (CN) ..... 202110180546.X

(51) Int. Cl.
*F25D 21/00* (2006.01)
*F24D 3/18* (2006.01)
(Continued)

(52) U.S. Cl.
CPC ..... *F25D 21/006* (2013.01); *F24D 3/18* (2013.01); *F24D 19/1039* (2013.01);
(Continued)

(58) Field of Classification Search
CPC ..... F24F 11/41; F24F 15/136; F24F 15/176; F24F 15/215; F24F 15/219; F24F 15/34;
(Continued)

(56) References Cited

U.S. PATENT DOCUMENTS

2019/0390873 A1* 12/2019 Suzuki ..... F25B 1/00

FOREIGN PATENT DOCUMENTS

CN 211567595 U * 9/2020
EP 2103890 A1 * 9/2009 ..... F24D 11/0228
(Continued)

*Primary Examiner* — Kun Kai Ma

(74) *Attorney, Agent, or Firm* — MICHAEL BEST & FRIEDRICH LLP

(57) ABSTRACT

The present disclosure discloses a defrosting control method, a central controller and a heating system. The defrosting control method comprises: heating fluid in a flow passage between an inlet and an outlet of a first heat source by a second heat source, at least in a part of process of defrosting by the first heat source; acquiring an operation parameter of the first heat source, wherein the operation parameter comprises a water outlet temperature and/or a water return temperature and/or an operation parameter of a compressor of the first heat source, comparing a current value of the acquired operation parameter with a preset range of the operation parameter, and adjusting a heat exchange amount between the second heat source and the fluid when the acquired current value is within the preset range. The defrosting control method, the central controller and the heating system provided by the present disclosure can improve the defrosting efficiency while considering the heating comfort, and ensure the stable operation of the defrosting process.

20 Claims, 5 Drawing Sheets

(51) Int. Cl.

| | |
|---|---|
| ***F24D 19/10*** | (2006.01) |
| ***F24F 11/41*** | (2018.01) |
| ***F24H 15/136*** | (2022.01) |
| ***F24H 15/176*** | (2022.01) |
| ***F24H 15/215*** | (2022.01) |
| ***F24H 15/219*** | (2022.01) |
| ***F24H 15/34*** | (2022.01) |
| ***F24H 15/355*** | (2022.01) |
| ***F24H 15/36*** | (2022.01) |
| ***F24H 15/37*** | (2022.01) |
| ***F24H 15/429*** | (2022.01) |
| ***F25B 13/00*** | (2006.01) |
| ***F25B 30/02*** | (2006.01) |
| ***F25B 47/02*** | (2006.01) |
| ***F25D 21/08*** | (2006.01) |
| ***F25D 21/12*** | (2006.01) |

(52) U.S. Cl.

CPC ..... *F24F 11/41* (2018.01); *F24H 15/136* (2022.01); *F24H 15/176* (2022.01); *F24H 15/215* (2022.01); *F24H 15/219* (2022.01); *F24H 15/34* (2022.01); *F24H 15/355* (2022.01); *F24H 15/36* (2022.01); *F24H 15/37* (2022.01); *F24H 15/429* (2022.01); *F25B 47/025* (2013.01); *F25D 21/08* (2013.01); *F25D 21/12* (2013.01); *F24D 2200/04* (2013.01); *F24D 2200/123* (2013.01); *F25B 13/00* (2013.01); *F25B 30/02* (2013.01); *F25B 2700/21161* (2013.01)

(58) Field of Classification Search

CPC ..... F24F 15/355; F24F 15/429; F24H 15/36; F24H 15/37; F24H 4/02; F24H 9/2007; F25D 21/08; F25D 21/12; F25B 13/00; F25B 30/02; F25B 2700/2116

See application file for complete search history.

(56) References Cited

FOREIGN PATENT DOCUMENTS

| | | | | |
|---|---|---|---|---|
| JP | 2008064444 A | * | 3/2008 | |
| JP | 6394329 B2 | * | 9/2018 | ..... F24H 4/02 |
| WO | WO-2010090071 A1 | * | 8/2010 | ..... F24D 19/0095 |

* cited by examiner

DEFROSTING CONTROL METHOD, CENTRAL CONTROLLER AND HEATING SYSTEM

TECHNICAL FIELD

The present disclosure relates to a technical field of heat exchange systems, and particularly to a defrosting control method, a central controller and a heating system.

BACKGROUND ART

A heat pump water heater is a device that transfers heat from a low-temperature object to high-temperature water through a medium (refrigerant) using the inverse Carnot principle. The working procedure of the heat pump water heater is that a compressor compresses a low-pressure refrigerant at an outlet of an evaporator into a high-temperature and high-pressure gas to be discharged, which flows through a condenser for cooling and undergoes a phase change, so that the heat is transferred to water in a liner through the condenser. The liquid refrigerant enters the evaporator after passing through an expansion valve, and since a pressure at the evaporator is low, the liquid refrigerant evaporates rapidly into a gaseous state, and absorbs a large amount of heat. Meanwhile, under the action of a fan, a large amount of air flows through an outer surface of the evaporator so that energy in the air is absorbed by the evaporator, and an air temperature decreases rapidly. Next, the refrigerant absorbing a certain amount of energy flows back to the compressor and enters a next cycle.

When the heat pump water heater operates in a low temperature environment, frost will occur on a surface of the evaporator if a temperature and a humidity reach certain conditions. As time elapses, the frost will become increasingly thicker if not being eliminated, which will gradually affect the heating performance of the heat pump water heater, and even make the heat pump water heater be unable to heat normally. At present, a defrosting mode mainly adopted by heat pump water heater is reverse defrosting.

The applicant finds that in related arts, when the heat pump water heater enters the defrosting mode, not only the user's heating comfort is seriously affected, but also a defrosting efficiency and a defrosting reliability are not high.

SUMMARY OF THE DISCLOSURE

In order to overcome the defects of the prior arts, a technical problem to be solved by the embodiments of the present disclosure is to provide a defrosting control method, a central controller and a heating system, which can improve the defrosting efficiency while considering the heating comfort, and ensure the stable operation of the defrosting process.

The specific technical solutions of the embodiments of the present disclosure include:

A defrosting control method, comprising steps of:

heating fluid in a flow passage between an inlet and an outlet of a first heat source by a second heat source, at least in a part of process of defrosting by the first heat source;

acquiring an operation parameter of the first heat source, wherein the operation parameter comprises a water outlet temperature and/or a water return temperature and/or an operation parameter of a compressor of the first heat source, comparing a current value of the acquired operation parameter with a preset range of the operation parameter, and adjusting a heat exchange amount between the second heat source and the fluid when the acquired current value is within the preset range.

Further, the second heat source is started before, when or after the first heat source enters a defrosting mode.

Further, when the second heat source is started, the method further comprises: controlling a water supply temperature of the second heat source to be less than a set water supply temperature of the first heat source, and shutting down the first heat source when the water supply temperature of the first heat source is not less than the set water supply temperature.

Further, the step of acquiring an operation parameter of the first heat source, comparing a current value of the acquired operation parameter with a preset range of the operation parameter, and adjusting a heat exchange amount between the second heat source and the fluid when the acquired current value is within the preset range comprises:

acquiring a water return temperature and a preset water return temperature of the first heat source, and shutting down the first heat source when the water return temperature is greater than the preset water return temperature;

determining a first equivalent water return temperature, which is equal to a difference between the preset water return temperature and a first preset value;

comparing the first equivalent water return temperature with the acquired water return temperature of the first heat source, and reducing the heat exchange amount between the second heat source and the fluid or controlling the second heat source to stop heating when the acquired water return temperature of the first heat source is not less than the first equivalent water return temperature.

Further, in a case where a heat exchange device is disposed in the flow passage, and water supplied by the second heat source exchanges heat with water in the flow passage through the heat exchange device, a water supply temperature of the second heat source is controlled to be less than a sum of a set water supply temperature of the first heat source and a second preset value, and the first heat source is shut down when a water supply temperature of the first heat source is not less than the set water supply temperature.

Further, in a case where the second heat source is provided with a water pump and the water pump continues operating for a first preset duration after the second heat source stops heating, the step of acquiring an operation parameter of the first heat source, comparing a current value of the acquired operation parameter with a preset range of the operation parameter, and adjusting a heat exchange amount between the second heat source and the fluid when the acquired current value is within the preset range comprises:

acquiring a water return temperature and a preset water return temperature of the first heat source, and shutting down the first heat source when the water return temperature is greater than the preset water return temperature;

determining a second equivalent water return temperature, which is equal to a difference between the preset water return temperature and a third preset value;

comparing the second equivalent water return temperature with the acquired water return temperature of the first heat source, and reducing the heat exchange amount between the second heat source and the fluid or controlling the second heat source to stop heating when the acquired water return temperature of the first heat source is not less than the second equivalent water return temperature.

Further, the first preset value is at least positively correlated with residual heat in a pipeline of the second heat source.

Further, the second preset value is at least negatively correlated with a heat exchange coefficient of the heat exchange device.

Further, the third preset value is at least positively correlated with residual heat in a pipeline of the second heat source.

Further, when the flow passage is provided with a heat exchange device, the defrosting control method further comprises: increasing the heat exchange amount between the second heat source and the fluid when an ambient temperature of an environment of the heat exchange device is decreased.

Further, the operation parameter of the compressor comprises a discharge pressure of the compressor of the first heat source and/or an electrical parameter of the compressor of the first heat source, and when the discharge pressure is greater than a preset discharge pressure or the electrical parameter is greater than a preset electrical parameter, the heat exchange amount between the second heat source and the fluid is adjusted.

A central controller, wherein the central controller is configured to perform the defrosting control method aforementioned.

A heating system, comprising the central controller aforementioned, a first heat source and a second heat source which are communicable with the central controller, and a heat exchange device which is at least communicable with the first heat source through a pipeline.

Further, the first heat source is provided with an outlet and an inlet, and the pipeline comprises a water inlet pipeline disposed between the outlet and the heat exchange device, and a water return pipeline disposed between the heat exchange device and the inlet, the second heat source being configured to increase a temperature of fluid in the water inlet pipeline or the water return pipeline.

Further, the heating system further comprises a heat exchange device disposed in the pipeline, wherein the heat exchange device is disposed in the water inlet pipeline or the water return pipeline, and water supplied by the second heat source exchanges heat with water in the pipeline through the heat exchange device.

Further, the heat exchange device comprises any one of a plate heat exchanger and a water mixing device.

Further, the first heat source is an air conditioner or a heat pump, and the second heat source is a gas combustion device or an electric heating device.

The technical solutions of the present disclosure have the following obvious advantageous effects:

According to the defrosting control method provided by the present disclosure, by heating fluid in a flow passage between an inlet and an outlet of a first heat source by a second heat source, at least in a part of process of defrosting by the first heat source, and subsequently, acquiring an operation parameter of the first heat source to monitor a working state of the first heat source, and adaptively adjusting a heat exchange amount between the second heat source and the fluid, at least a temperature of the fluid supplied to a user side can be efficiently increased during defrosting by the first heat source. On the one hand, a large temperature fluctuation will not occur during defrosting to ensure the user's heating comfort. On the other hand, by increasing the temperature of the fluid, a defrosting duration can be shortened and a defrosting efficiency can be improved. Especially, the heat exchange amount between the second heat source and the fluid can be adjusted according to the monitored operation parameter of the first heat source, so as to ensure that the first heat source can run stably and reliably for defrosting when the second heat source assists the first heat source in defrosting.

With reference to the following descriptions and drawings, the particular embodiments of the present disclosure will be disclosed in detail to indicate the ways in which the principle of the present disclosure can be adopted. It should be understood that the scope of the embodiments of the present disclosure are not limited thereto. The embodiments of the present disclosure include many changes, modifications and equivalents within the spirit and clauses of the appended claims. The features described and/or illustrated with respect to one embodiment may be used in one or more other embodiments in the same or similar way, may be combined with the features in other embodiments, or may take place of those features.

BRIEF DESCRIPTION OF THE DRAWINGS

The drawings described here are for explanatory purposes only and are not intended to limit the scope of the present disclosure in any way. In addition, the shapes and proportional sizes of the components in the drawings are just schematic to help the understanding of the present disclosure, rather than specifically limiting the shapes and proportional sizes of the components of the present disclosure. Under the teaching of the present disclosure, persons skilled in the art can select various possible shapes and proportional sizes according to specific conditions to carry out the present disclosure.

Reference signs in the above drawings:

1: first heat source;
11: inlet;
12: outlet;
13: compressor;
2: second heat source;
3: heat exchange device;
4: heat exchange device;
51: water inlet pipeline;
52: water return pipeline.

DETAILED DESCRIPTION OF THE PREFERRED EMBODIMENTS

The technical solutions of the present disclosure will be described in detail as follows with reference to the drawings and the specific embodiments. It should be understood that these embodiments are only used to illustrate the present disclosure rather than limiting the scope thereof. After reading the present disclosure, any equivalent modification made by persons skilled in the art to the present disclosure falls within the scope defined by the appended claims of the present disclosure.

It should be noted that when an element is referred to as being 'disposed' on another element, it may be directly on another element or there may be an intermediate element. When an element is considered to be 'connected' to another element, it may be directly connected to another element or there may be an intermediate element. As used herein, the terms 'vertical', 'horizontal', 'upper', 'lower', 'left', 'right' and similar expressions are only for the purpose of illustration, rather than indicating unique embodiments.

Unless otherwise defined, all technical and scientific terms used herein have the same meanings as those generally understood by persons skilled in the art of the present disclosure. The terms used herein are only for the purpose of describing the specific embodiments and are not intended to limit the present disclosure. As used herein, the term 'and/or' includes any and all combinations of one or more associated listed items.

Figure 1:
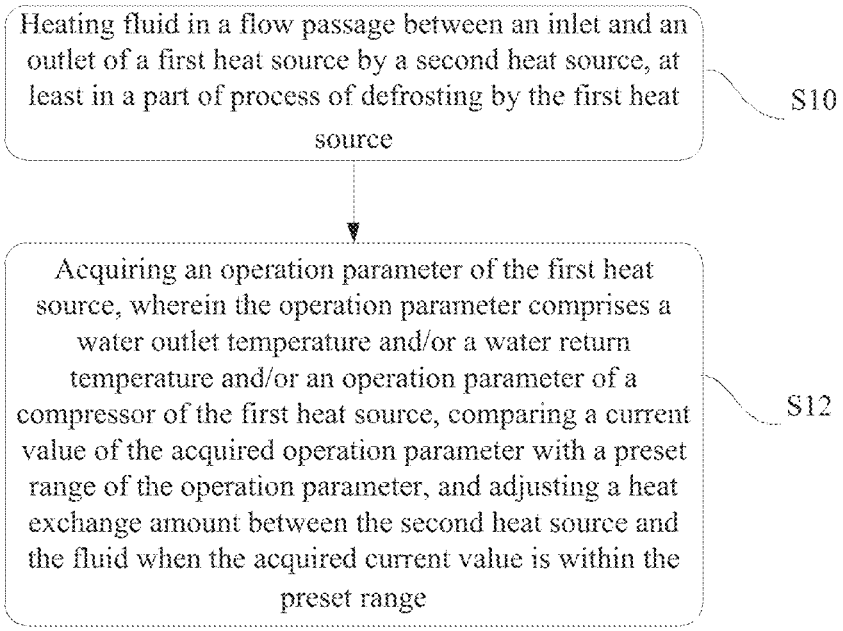
FIG. 1 is a flowchart of steps of a defrosting control method provided in an embodiment of the present disclosure.

Referring to FIG. 1, an embodiment of the specification of the present disclosure provides a defrosting control method, which may include the following steps:

S10: heating fluid in a flow passage between an inlet 11 and an outlet 12 of a first heat source 1 by a second heat source 2, at least in a part of process of defrosting by the first heat source 1; and S12: acquiring an operation parameter of the first heat source 1, wherein the operation parameter comprises a water outlet temperature and/or a water return temperature and/or an operation parameter of a compressor 13 of the first heat source 1, comparing a current value of the acquired operation parameter with a preset range of the operation parameter, and adjusting a heat exchange amount between the second heat source 2 and the fluid when the acquired current value is within the preset range.

In this embodiment, the first heat source 1 is a heating device capable of supplying heat. The first heat source 1 specifically may be a heat pump water heater, an air conditioner, or any other heating system that needs to set a defrosting mode for defrosting in a specific environment. In this specification, the first heat source 1 is mainly illustrated by taking a heat pump water heater (referred to as a heat pump for short) as an example, and other forms can be referred to by analogy, which will not be described in detail here.

In this embodiment, the second heat source 2 is mainly used to supply heat in the defrosting process of the first heat source 1. Specifically, the second heat source 2 may be a gas combustion device or an electric heating device. Of course, the second heat source 2 may also be any other heating device capable of supplying heat, such as a new energy heating device. When the second heat source 2 is a gas combustion device, it specifically may be a wall-hung boiler or a gas water heater. When the second heat source 2 is an electric heating device, it specifically may be an electric water heater. In this specification, the second heat source 2 is mainly illustrated by taking a wall-hung boiler as an example, and other forms can be referred to by analogy, which will not be described in detail here.

In this embodiment, the first heat source 1 has a plurality of modes, including a heating mode, a defrosting mode, a cooling mode, etc. When judging that it is necessary to enter the defrosting mode to defrost the evaporator, the heat pump may start the second heat source 2 and heat the fluid in the flow passage between the inlet 11 and the outlet 12 of the first heat source 1 using the second heat source 2, thereby reducing the heat absorbed by the fluid indoors and preventing an indoor temperature from dropping greatly. When the second heat source supplies more heat, the indoor temperature may be kept constant or increased appropriately.

Figure 2:
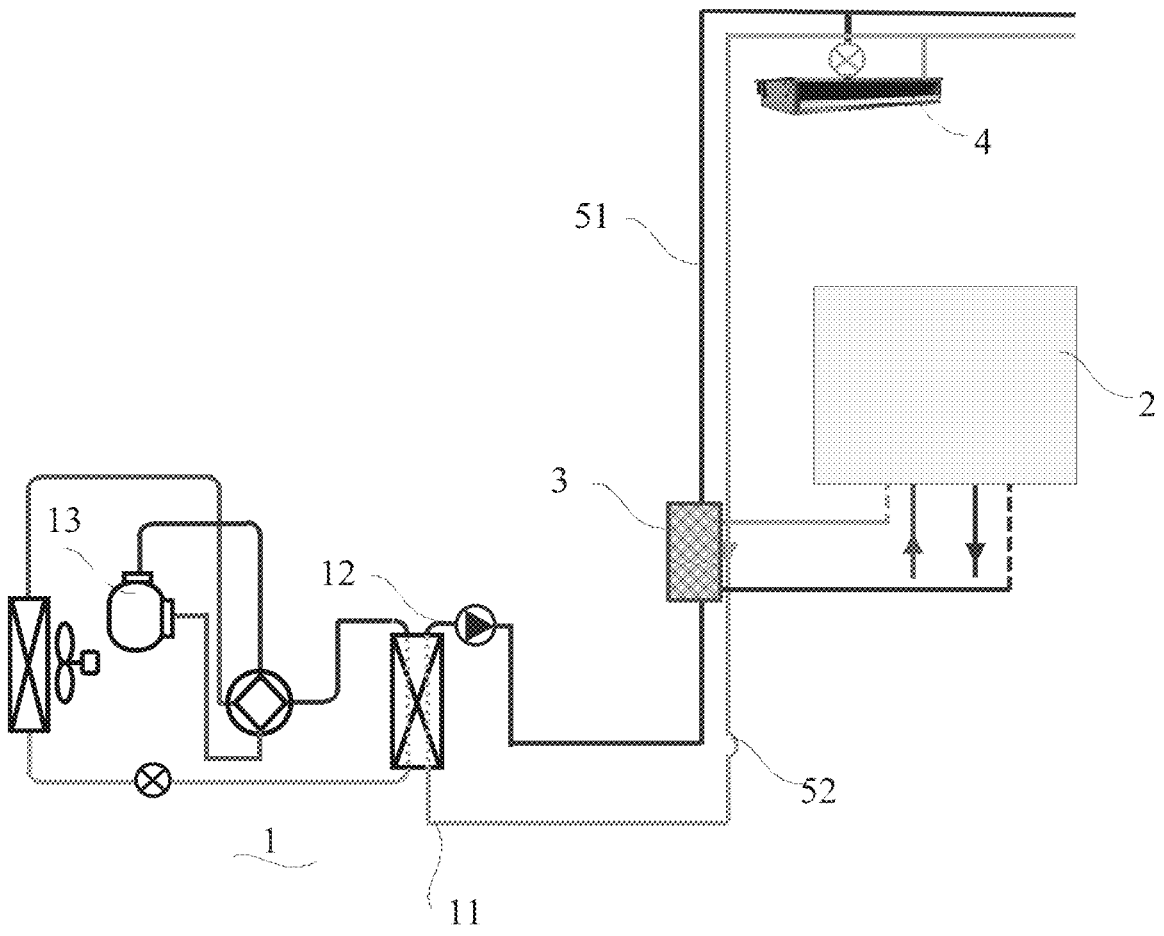
FIG. 2 is a schematic structural diagram of a heating system provided in an embodiment of the present disclosure.

As illustrated in FIG. 2, in one embodiment, the first heat source 1 is provided with an outlet 12 and an inlet 11. The outlet 12 serves as a water outlet end of the first heat source 1, and the inlet 11 serves as a water return end of the first heat source 1. The pipeline comprises a water inlet pipeline 51 disposed between the outlet 12 and the heat exchange device 4, and a water return pipeline 52 disposed between the heat exchange device 4 and the inlet 11. The second heat source 2 may be used to increase a temperature of fluid in the water inlet pipeline 51 or the water return pipeline 52. In addition, the pipeline may also comprise a connection pipeline between the water inlet end of the water inlet pipeline 51 and the water outlet end of the water return pipeline 52, and the second heat source 2 may also heat the connection pipeline.

Specifically, the second heat source 2 may be started in advance before the first heat source 1 enters the defrosting mode. For example, when the heat pump judges that it is necessary to enter the defrosting mode based on information acquired by a sensor, the second heat source 2 is started firstly, and then the working mode is switched. The information acquired by the sensor comprises: an ambient temperature, an evaporator temperature, an operation duration of the compressor 13, etc.

Alternatively, the second heat source 2 is started while the defrosting mode is entered. For example, when the heat pump judges that it is necessary to enter the defrosting mode, the working mode may be switched while the first heat source 1 is started. In addition, the second heat source 2 may be started after the heat pump enters the defrosting mode for a period of time. Further, after entering the defrosting mode, the heat pump may judge whether the second heat source 2 should be started based on the information acquired by the sensor, and when a condition for starting the second heat source 2 is met, the second heat source 2 is started.

In this embodiment, the acquired operation parameter of the first heat source 1 may be used as a basis for adjusting the heat exchange amount between the second heat source 2 and the fluid. Specifically, the operation parameter of the first heat source 1 may comprise one or combinations of a water outlet temperature, a water return temperature and an operation parameter of the compressor 13 of the first heat source 1.

The operation parameter of the compressor 13 of the first heat source 1 mainly comprise one or combinations of a discharge pressure and an electrical parameter of the compressor 13. The discharge pressure increases as the water outlet temperature rises. That is, the water outlet temperature is positively correlated with the discharge pressure. In addition, the electrical parameter of the compressor 13 is mainly explained by taking the current as an example, and of course, any other parameter equivalent to the current may also be included, which is not specifically limited here. The current of the compressor 13 increases as the water outlet temperature rises. That is, the water outlet temperature is positively correlated with the current of the compressor 13.

After acquiring the operation parameter of the first heat source 1, a current value of the acquired operation parameter may be compared with a preset range of the operation parameter, and a heat exchange amount between the second heat source and the fluid may be adjusted based on a comparison result.

The adjustment of the heat exchange amount between the second heat source 2 and the fluid may be realized in various ways. When the second heat source 2 is a gas water heater or a wall-hung boiler, a combustion load of the second heat source 2 may be adjusted, or rotation speeds of the water pumps in the second heat source 2 and the first heat source 1 may be adjusted to change a flow velocity of a heat exchange fluid. In addition, when the flow passage is provided with a heat exchange device 3, the adjustment may be performed by adjusting a heat exchange coefficient of the heat exchange device 3.

The adjustment comprises increasing and/or decreasing the heat exchange amount between the second heat source 2.

In this specification, the operation parameter of the first heat source 1 is explained in detail by taking the water return temperature as an example. A water return temperature is set for the heat pump, and when the water return temperature of the heat pump reaches a set value, the heat pump will be automatically shut down. For example, a lower limit value of the preset water return temperature may be 45° C., and a corresponding preset range is that the water return temperature is greater than or equal to 45° C. When the acquired water return temperature of the first heat source 1 reaches 45° C., i.e., greater than or equal to 45° C., the combustion load of the second heat source 2 may be reduced or the second heat source 2 may be controlled to stop combustion.

In addition, in the heat exchange process between the second heat source 2 and the fluid, in some special environments, if it is monitored that the water return temperature or the indoor temperature is decreasing, at this time, the combustion load of the second heat source 2 may be increased to ensure a comfortable room temperature.

If the water return temperature exceeds the preset value after the second heat source 2 is connected, the first heat source 1 may be shut down unexpectedly before defrosting is completed. If the first heat source 1 is started with frost at low frequency for heating, it will take a long time (generally at least 30 minutes) to reach a stable working stage with a higher heat output, and at this time, the room temperature corresponding to the user side will rise very slowly. On the other hand, when the water return temperature is low, the first heat source 1 started with frost is easy to be subjected to frequent start and stop, thus causing a large fluctuation in the water temperature, which is not conducive to ensuring the user comfort.

In the embodiment of where the heat exchange amount between the second heat source 2 and the fluid is increased, when the flow passage is provided with a heat exchange device 4, the defrosting control method further comprises: increasing the heat exchange amount between the second heat source 2 and the fluid when an ambient temperature of an environment of the heat exchange device 4 is decreased.

The heat exchange device 4 transfers the heat in the fluid to the air. The heat exchange device 4 specifically may be a fan coil or any other form, which is not specifically limited here. In this specification, the heat exchange device 4 is mainly illustrated by taking a fan coil as an example.

When the ambient temperature of the environment of the heat exchange device 4 decreases, the heat supplied to the environment of the heat exchange device 4 may be increased by increasing the heat exchange amount between the second heat source 2 and the fluid. Specifically, the ways to increase the heat exchange amount between the second heat source 2 and the fluid may comprise: increasing the combustion load of the second heat source 2, adjusting a flow velocity and a flow rate of the high-temperature fluid supplied by the second heat source 2, etc., which is not specifically limited here.

In one embodiment, when the second heat source 2 is started, the method further comprises: a water supply temperature of the second heat source 2 to be less than a set water supply temperature of the first heat source 1, and shutting down the first heat source 1 when the water supply temperature of the first heat source 1 is not less than the set water supply temperature.

In this embodiment, the first heat source 1 has different limit water supply temperatures (i.e., highest water outlet temperatures) depending on specific forms. For example, when the first heat source 1 is a heat pump, the highest water outlet temperature of the first heat source 1 may be 60° C. When the water outlet temperature reaches 60° C., the first heat source 1 will be automatically shut down.

Figure 3:
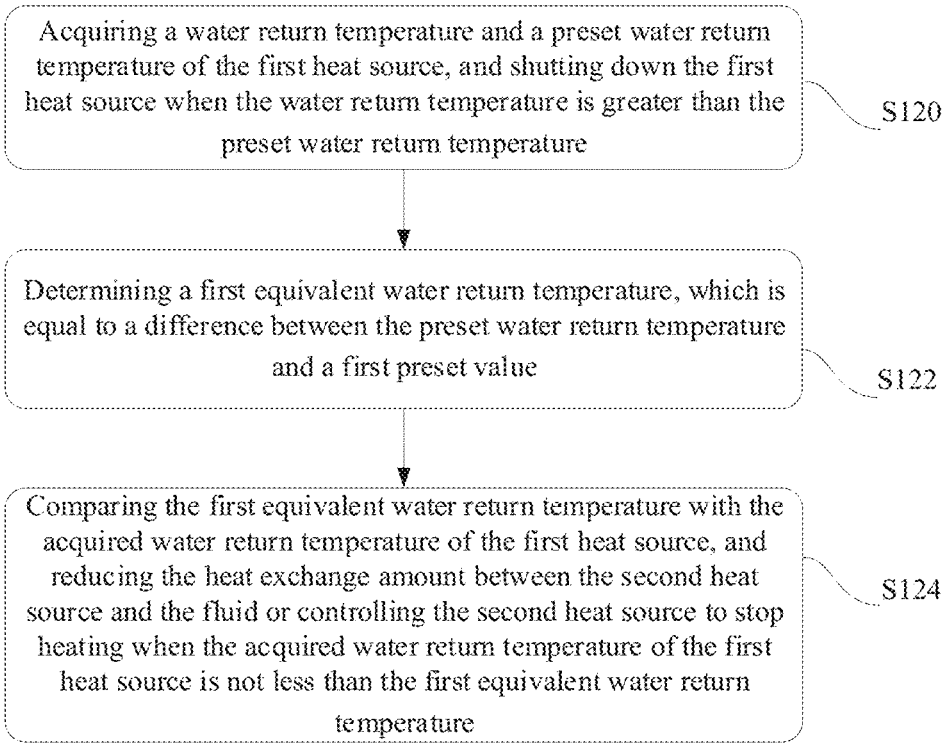
FIG. 3 is a flowchart of steps of a defrosting control method provided in an embodiment of the present disclosure.

As illustrated in FIG. 3, in one embodiment, step S12 of acquiring an operation parameter of the first heat source 1, comparing a current value of the acquired operation parameter with a preset range of the operation parameter, and adjusting a heat exchange amount between the second heat source 2 and the fluid when the acquired current value is within the preset range may specifically comprise the following steps:

- S120: acquiring a water return temperature and a preset water return temperature of the first heat source 1, and shutting down the first heat source 1 when the water return temperature is greater than the preset water return temperature;
- S122: determining a first equivalent water return temperature, which is equal to a difference between the preset water return temperature and a first preset value;
- S124: comparing the first equivalent water return temperature with the acquired water return temperature of the first heat source 1, and reducing the heat exchange amount between the second heat source 2 and the fluid or controlling the second heat source 2 to stop heating when the acquired water return temperature of the first heat source 1 is not less than the first equivalent water return temperature.

In this embodiment, in the defrosting process of the first heat source 1, the heat is supplied by the second heat source 2 to the fluid, thereby increasing the water return temperature. When the second heat source 2 stops heating, the water temperature in the pipeline of the second heat source 2 is high and there is residual heat, which will continue supplying heat to the fluid. The residual heat in the pipeline of the second heat source 2 increases the temperature of the fluid in the pipeline by a first preset value. The first preset value is at least positively correlated with the residual heat in the pipeline of the second heat source 2. Specifically, the first preset value increases along with the residual heat in the pipeline of the second heat source 2. In addition, the preset water return temperature is also taken as a reference standard for shutting down the first heat source 1. When the acquired current water return temperature is greater than the preset water return temperature, the first heat source 1 is shut down. When the first heat source 1 is a heat pump, the preset water return temperature may also be called as a shutdown temperature of the heat pump. Once the water return temperature reaches or exceeds the preset water return temperature, the heat pump is shut down for protection.

For step S120, the water return temperature of the first heat source 1 may be a water temperature signal acquired in real time or periodically, and the preset water return temperature and the first preset value may be stored in a memory in advance.

The first equivalent water return temperature may be determined after step S122 is continued. The first equivalent water return temperature is equal to a difference between the preset water return temperature and a first preset value. The first equivalent water return temperature is taken as a comparison temperature for the actually acquired water return temperature of the first heat source 1.

When step S124 is performed, that is, when the first equivalent water return temperature is compared with the acquired water return temperature of the first heat pump, the heat exchange amount between the second heat source 2 and the fluid may be reduced or the second heat source 2 may be controlled to stop heating if the current water return temperature of the first heat source 1 is greater than or equal to the first equivalent water return temperature.

In some embodiments, when a heat exchange device 3 is disposed in the flow passage, and water supplied by the second heat source 2 exchanges heat with water in the flow passage through the heat exchange device 3, a water supply temperature of the second heat source 2 is controlled to be less than a sum of a set water supply temperature of the first heat source 1 and a second preset value, and the first heat source 1 is shut down when a water supply temperature of the first heat source 1 is not less than the set water supply temperature.

In this embodiment, the heat exchange device 3 may be disposed in the flow passage between the inlet 11 and the outlet 12 of the first heat source 1. Specifically, the heat exchange device 3 comprises any one of a plate heat exchanger and a water mixing device. When the heat exchange device 3 is a water mixing device, it specifically may be a three-way structure or a four-way structure. In addition, the heat exchange device 3 may be in other forms, such as a water mixing tank.

A water inlet pipeline 51 is disposed between the outlet 12 and the heat exchanger 4, and a water return pipeline 52 is disposed between the heat exchanger 4 and the inlet 11. The heat exchange device 3 may be disposed in the water inlet pipeline 51 or the water return pipeline 52, and the water supplied by the second heat source 2 exchanges heat with the water in the pipeline through the heat exchange device 3.

As illustrated in FIG. 2, in this specification, the description is given through an example where the heat exchange device 3 is disposed in the water inlet pipeline 51.

In a case where the water supplied by the second heat source 2 exchanges heat with the water in the flow passage through the heat exchange device 3, the water supply temperature of the second heat source 2 is controlled to be less than a sum of the set water supply temperature of the first heat source 1 and a second preset value.

The second preset value mainly depends on a temperature attenuation caused by the heat exchange device 3. Specifically, the second preset value is at least negatively correlated with a heat exchange coefficient of the heat exchange device 3. As the heat exchange coefficient of the heat exchange device 3 increases, a temperature difference between the fluid supplied from the first heat source 1 into the heat exchange device 3 and the fluid supplied from the second heat source 2 into the heat exchange device 3 decreases, and then the second preset value decreases. On the contrary, as the heat exchange coefficient of the heat exchange device 3 decreases, the temperature difference between the fluid supplied from the first heat source 1 into the heat exchange device 3 and the fluid supplied from the second heat source 2 into the heat exchange device 3 increases, and then the second preset value increases. The heat exchange coefficient itself is related to a heat exchange area and a flow velocity.

The set water supply temperature is also a shutdown temperature of the first heat source 1. When the water supply temperature of the first heat source 1 is not less than the set water supply temperature, the first heat source 1 is shut down. Specifically, the heat pump may have a plurality of set water supply temperatures for the user's selection, and core working parameters of respective parts of the heat pump are correspondingly stored for each of the water supply temperatures. Once a real-time water supply temperature reaches or exceeds the currently set water supply temperature, the heat pump should be shut down for protection, otherwise, the normal working performance of the heat pump cannot be guaranteed.

Figure 4:
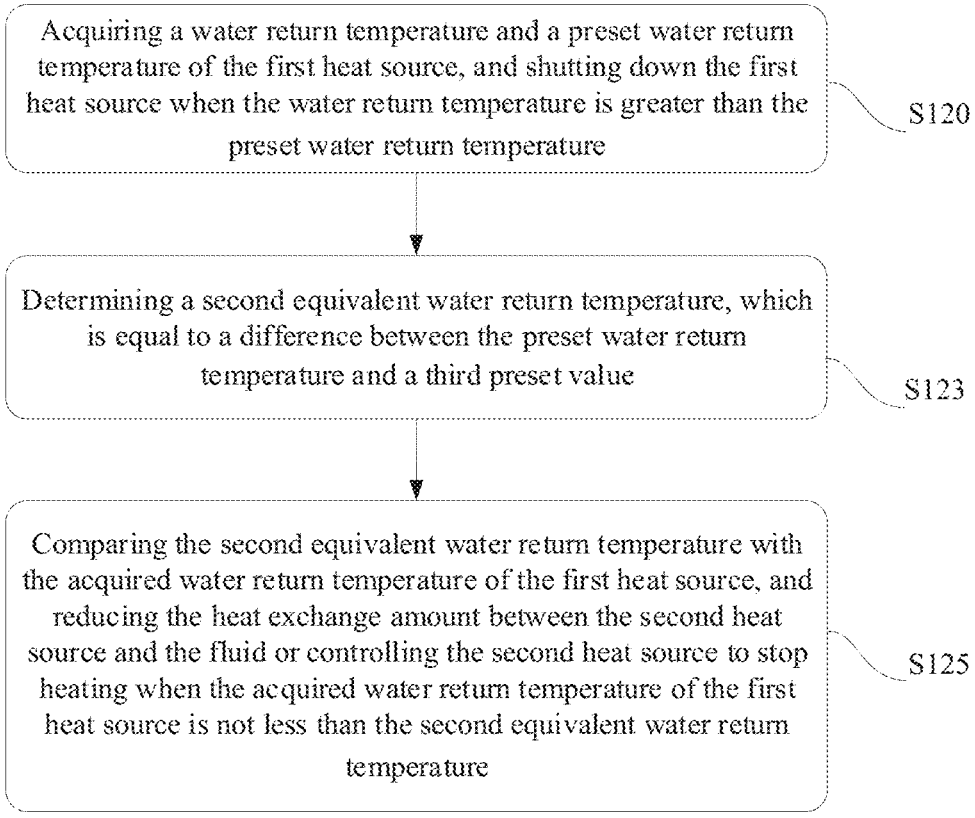
FIG. 4 is another flowchart of steps of a defrosting control method provided in an embodiment of the present disclosure.

As illustrated in FIG. 4, in some embodiments, in a case where the second heat source 2 is provided with a water pump which continues operating for a first preset duration after the second heat source 2 stops heating, step S12 of acquiring an operation parameter of the first heat source 1, comparing a current value of the acquired operation parameter with a preset range of the operation parameter, and adjusting a heat exchange amount between the second heat source 2 and the fluid when the acquired current value is within the preset range may specifically comprise the following steps:

- S120: acquiring a water return temperature and a preset water return temperature of the first heat source 1, and shutting down the first heat source 1 when the water return temperature is greater than the preset water return temperature;
- S123: determining a second equivalent water return temperature, which is equal to a difference between the preset water return temperature and a third preset value;
- S125: comparing the second equivalent water return temperature with the acquired water return temperature of the first heat source 1, and reducing the heat exchange amount between the second heat source 2 and the fluid or controlling the second heat source 2 to stop heating when the acquired water return temperature of the first heat source 1 is not less than the second equivalent water return temperature.

In this embodiment, after the second heat source 2 stops heating, the water pump continues operating for a first preset duration. On the one hand, the heated fluid in the pipeline is driven by the water pump, so that the heat of the water in the pipeline is used to heat the fluid in the pipeline between the inlet 11 and the outlet 12 of the first heat source 1. On the other hand, the circulating fluid may be used to cool the burner row in the combustor and prevent scaling thereof, and at the same time, after a heat exchange with the burner row, the heat in the burner row can also be absorbed to increase the temperature of the fluid.

As compared with the above embodiment including steps S120 to S124, this embodiment mainly has a difference in that the water pump still continues operating for the first preset duration after the second heat source 2 stops heating, so that the temperature rise of the fluid between the inlet 11 and the outlet 12 of the first heat source 1 caused by the water in the pipeline of the second heat source 2 during the circulation may be higher.

Specifically, the specific description of step S120 may refer to the above embodiment, which will not be repeated here.

When step S123 is performed, the second equivalent water return temperature may be determined, which is equal to a difference between the preset water return temperature and a third preset value. The third preset value is at least positively correlated with the residual heat in the pipeline of the second heat source 2. That is, the third preset value increases along with the residual heat in the pipeline of the second heat source 2. The second equivalent water return temperature is taken as a comparison temperature for the actually acquired water return temperature of the first heat source 1.

When step S125 is performed, that is, when the second equivalent water return temperature is compared with the acquired water return temperature of the first heat pump, the heat exchange amount between the second heat source 2 and the fluid may be reduced or the second heat source 2 may be controlled to stop heating if the current water return temperature of the first heat source 1 is greater than or equal to the second equivalent water return temperature.

This specification further provides a central controller configured to perform the defrosting control method described above. Specifically, the central controller may be provided independently from or integrally with the first heat source 1 and the second heat source 2, which is not specifically limited here. In use, the central controller may establish communications with the first heat source 1 and the second heat source 2.

This specification further provides a heating system, comprising the central controller described in the above embodiment, a first heat source 1 and a second heat source 2 which are communicable with the central controller, and a heat exchange device 4 which is at least communicable with the first heat source 1 through a pipeline. For the specific forms, the cooperatively realized functions, etc. of the first heat source 1, the second heat source 2 and the heat exchange device 4, please refer to the specific descriptions in the above embodiments, which will not be repeated here.

In one embodiment, the first heat source 1 is provided with an outlet 12 and an inlet 11; the pipeline comprises a water inlet pipeline 51 disposed between the outlet 12 and the heat exchange device 4 and a water return pipeline 52 disposed between the heat exchange device 4 and the inlet 11; and the second heat source 2 is used to increase a temperature of fluid in the water inlet pipeline 51 or the water return pipeline 52. As illustrated in FIG. 2, the heating system further comprises a heat exchange device 3 disposed in the pipeline. The heat exchange device 3 is disposed in the water inlet pipeline 51 or the water return pipeline 52, and water supplied by the second heat source 2 exchanges heat with water in the pipeline through the heat exchange device 3.

Based on the defrosting control method provided in this specification, by heating fluid in a flow passage between an inlet 11 and an outlet 12 of a first heat source 1 by a second heat source 2, at least in a part of process of defrosting by the first heat source 1, and subsequently, acquiring an operation parameter of the first heat source 1 to monitor a working state of the first heat source 1, and adaptively adjusting a heat exchange amount between the second heat source 2 and the fluid, the applicant can efficiently increase at least a temperature of the fluid supplied to a user side during defrosting by the first heat source 1. On the one hand, a large temperature fluctuation will not occur during defrosting to ensure the user's heating comfort. On the other hand, by increasing the temperature of the fluid, a defrosting duration can be shortened and a defrosting efficiency can be improved. Especially, the heat exchange amount between the second heat source 2 and the fluid can be adjusted according to the monitored operation parameter of the first heat source 1, so as to ensure that the first heat source can run stably and reliably.

Figure 5:
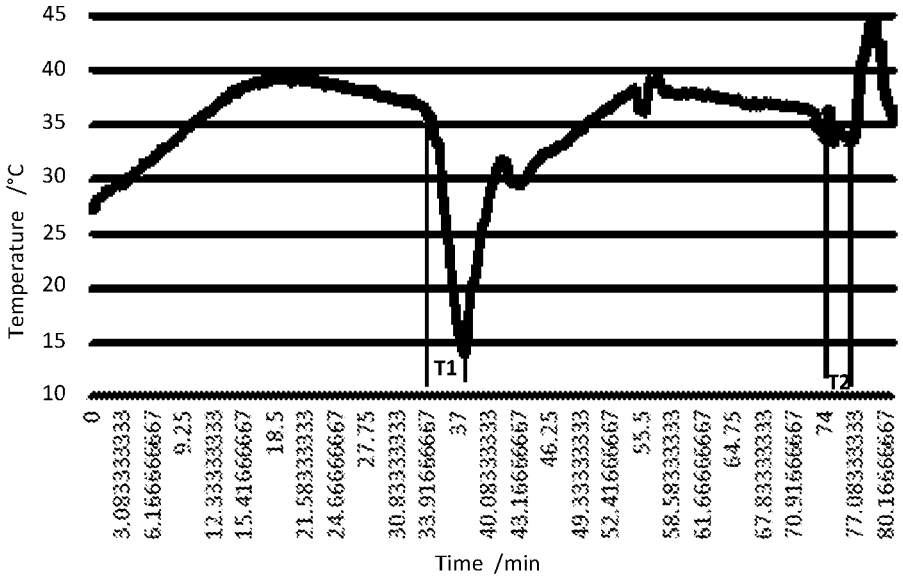
FIG. 5 is a graph of a comparison between air outlet temperatures of a fan coil before and after a second heat source is connected.
Figure 6:
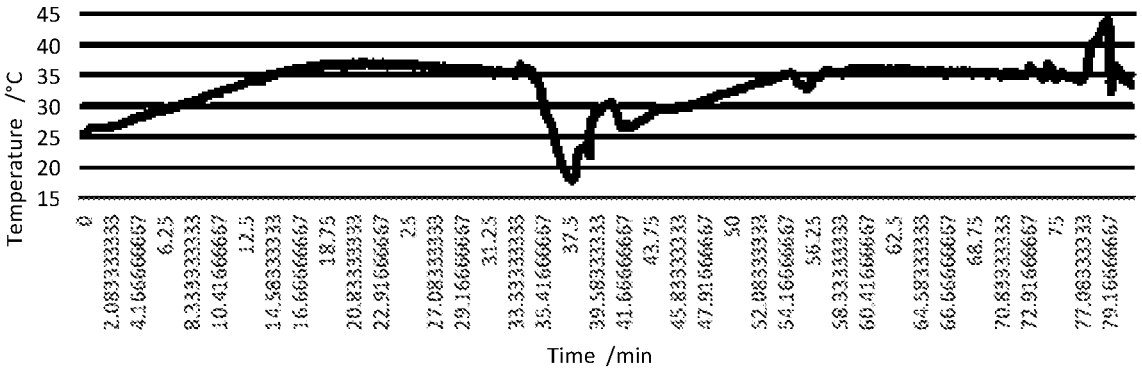
FIG. 6 is a graph of a comparison between water return temperatures of a heat pump before and after a second heat source is connected.

With reference to FIGS. 5 and 6, in a specific application scenario, the applicant carries out an experimental verification of the technical effect produced by the defrosting control method provided in this specification. The description is given through an example where the first heat source 1 is a heat pump, the second heat source 2 is a wall-hung boiler, and the heat exchange device 4 is a fan coil.

As illustrated in FIG. 5, which is a graph of a comparison between air outlet temperatures of a fan coil before and after a wall-hung boiler is connected. The abscissa indicates an operation duration, and the ordinate indicates an air outlet temperature of the fan coil. It can be clearly seen from FIG. 3 that before the wall-hung boiler is connected, a defrosting time T1 of the heat pump is about 6 minutes, and it takes about 17 minutes for the water temperature to reach a pre-defrosting state from the beginning to the end of the defrosting. At this time, the air outlet temperature of the fan coil fluctuates greatly, and it drops sharply after the defrosting mode is entered. When the wall-hung boiler is connected, the defrosting mode of the heat pump lasts for a time T2 less than 3 minutes, and the air outlet temperature of the fan coil fluctuates slightly at this time. It is clear that after the wall-hung boiler is connected, the defrosting time can be shortened, and the air outlet temperature of the fan coil toward the user side fluctuates slightly.

As illustrated in FIG. 6, which is a graph of a comparison between water return temperatures of a heat pump before and after a wall-hung boiler is connected. The abscissa indicates an operation duration, and the ordinate indicates a water return temperature of the heat pump. It can also be clearly seen from FIG. 4 that before the wall-hung boiler is connected, the water return temperature of the wall-hung boiler fluctuates greatly, and it drops sharply after the defrosting mode is entered. When the wall-hung boiler is connected, the water return temperature of the wall-hung boiler fluctuates slightly. In addition, during the operation of the heat pump, the water return temperature of the heat pump can be monitored in real time. When the water return temperature reaches a set condition, the wall-hung boiler can be automatically turned off, and when the heat pump needs to enter the defrosting mode, the wall-hung boiler can be connected automatically. In the whole heating process, all parts of the system can operate stably and efficiently, while ensuring the user's heating comfort.

It should be noted that in the description of the present disclosure, the terms 'first', 'second', etc. are only used for descriptive purposes and to distinguish similar objects, and there is no order between them, nor can they be understood as indicating or implying relative importance. In addition, in the description of the present disclosure, unless otherwise specified, 'plurality of' means two or more.

The above embodiments in this specification are all described in a progressive manner, and the same or similar portions of the embodiments can refer to each other. Each embodiment lays an emphasis on its distinctions from other embodiments.

Those described above are just a few embodiments of the present disclosure. Although the embodiments disclosed by the present disclosure are given as above, the content thereof is only for the convenience of understanding the present disclosure, rather than limiting the present disclosure. Persons skilled in the art of the present disclosure can make any modification and change in the forms and details of the embodiments without departing from the spirit and scope disclosed by the present disclosure. However, the patent protection scope of the present disclosure should still be subject to the scope defined by the appended claims.

What is claimed is:

1. A defrosting control method, the method comprising steps of:

heating a fluid in a flow passage, the flow passage extending between an inlet and an outlet of a first heat source, the heating provided by a second heat source and provided at least in part to defrost the first heat source;

acquiring a value of an operation parameter of the first heat source, wherein the operation parameter comprises at least one selected from the group consisting of a water outlet temperature, a water return temperature, and an operation parameter of a compressor of the first heat source;

comparing the acquired value of the operation parameter with a preset range of the operation parameter;

determining that the acquired value is within the preset range; and adjusting an amount of heat exchanged between the second heat source and the fluid in response to determining the acquired value is within the preset range, wherein the second heat source is started before the first heat source enters a defrosting mode.

2. The defrosting control method according to claim 1, wherein the method further comprises controlling, after the second heat source is started, a water supply temperature of the second heat source to be less than a set water supply temperature of the first heat source, determining that the water supply temperature of the first heat source is not less than the set water supply temperature of the first heat source, and in response, shutting down the first heat source.

3. The defrosting control method according to claim 1, wherein the flow passage is provided with a heat exchange device, and wherein the defrosting control method further comprises:

increasing the amount of heat exchanged between the second heat source and the fluid when an ambient temperature of an environment of the heat exchange device is decreased.

4. The defrosting control method according to claim 1, wherein the operation parameter of the compressor comprises at least one of a discharge pressure of the compressor of the first heat source and an electrical parameter of the compressor of the first heat source, further comprising adjusting the amount of heat exchanged between the second heat source and the fluid when (i) the discharge pressure of the compressor is greater than a preset discharge pressure or (ii) the electrical parameter is greater than a preset electrical parameter.

5. The defrosting control method according to claim 1, wherein the operation parameter includes a water return temperature of the first heat source, and the adjusting step includes shutting down the first heat source when the water return temperature is greater than a preset water return temperature, wherein the method further comprises:

determining an equivalent water return temperature, which is equal to a difference between the preset water return temperature and a preset value;

comparing the equivalent water return temperature with the water return temperature of the first heat source; and (i) reducing the amount of heat exchanged between the second heat source and the fluid or (ii) controlling the second heat source to stop heating in response to the water return temperature of the first heat source being not less than the equivalent water return temperature.

6. The defrosting control method according to claim 1, wherein the second heat source is provided with a water pump and the water pump continues operating for a first preset duration after the second heat source stops heating, wherein the operation parameter includes a water return temperature of the first heat source, and the adjusting step further includes shutting down the first heat source when the water return temperature is greater than a preset water return temperature, wherein the method further comprises:

determining an equivalent water return temperature, which is equal to a difference between the preset water return temperature and a preset value;

comparing the equivalent water return temperature with the water return temperature of the first heat source; and (i) reducing the amount of heat exchanged between the second heat source and the fluid or (ii) controlling the second heat source to stop heating in response to the water return temperature of the first heat source being not less than the equivalent water return temperature.

7. A defrosting control method, the method comprising steps of:

heating a fluid in a flow passage, the flow passage extending between an inlet and an outlet of a first heat source, the heating provided by a second heat source and provided at least in part to defrost the first heat source;

acquiring a value of an operation parameter of the first heat source, wherein the operation parameter comprises at least one selected from the group consisting of a water outlet temperature, a water return temperature, and an operation parameter of a compressor of the first heat source;

comparing the acquired value of the operation parameter with a preset range of the operation parameter;

determining that the acquired value is within the preset range; and adjusting an amount of heat exchanged between the second heat source and the fluid in response to determining the acquired value is within the preset range, wherein the operation parameter includes a water return temperature of the first heat source, and the adjusting step includes shutting down the first heat source when the water return temperature is greater than a preset water return temperature, wherein the method further comprises:

determining an equivalent water return temperature, which is equal to a difference between the preset water return temperature and a preset value;

comparing the equivalent water return temperature with the water return temperature of the first heat source; and (i) reducing an amount of heat exchanged between the second heat source and the fluid or (ii) controlling the second heat source to stop heating, in response to the water return temperature of the first heat source being not less than the equivalent water return temperature.

8. The defrosting control method according to claim 7, wherein the preset value is positively corelated with residual heat in a pipeline of the second heat source.

9. The defrosting control method according to claim 7, wherein the flow passage is provided with a heat exchange device, and wherein the defrosting control method further comprises:

increasing the amount of heat exchanged between the second heat source and the fluid when an ambient temperature of an environment of the heat exchange device is decreased.

10. The defrosting control method according to claim 7, wherein the operation parameter of the compressor comprises at least one of a discharge pressure of the compressor of the first heat source and an electrical parameter of the compressor of the first heat source, further comprising adjusting the amount of heat exchanged between the second heat source and the fluid when (i) the discharge pressure of the compressor is greater than a preset discharge pressure or (ii) the electrical parameter is greater than a preset electrical parameter.

11. A defrosting control method, the method comprising steps of:

heating a fluid in a flow passage, the flow passage extending between an inlet and an outlet of a first heat source, the heating provided by a second heat source and provided at least in part to defrost the first heat source;

acquiring a value of an operation parameter of the first heat source, wherein the operation parameter comprises at least one selected from the group consisting of a water outlet temperature, a water return temperature, and an operation parameter of a compressor of the first heat source;

comparing the acquired value of the operation parameter with a preset range of the operation parameter;

determining that the acquired value is within the preset range; and adjusting an amount of heat exchanged between the second heat source and the fluid in response to determining the acquired value is within the preset range, wherein water supplied by the second heat source exchanges heat with water in the flow passage through a heat exchange device disposed in the flow passage, a water supply temperature of the second heat source is controlled to be less than a sum of a set water supply temperature of the first heat source and a preset value, and the first heat source is shut down when a water supply temperature of the first heat source is not less than the set water supply temperature of the first heat source.

12. The defrosting control method according to claim 11, wherein the preset value is negatively correlated with a heat exchange coefficient of the heat exchange device.

13. The defrosting control method according to claim 11, wherein the defrosting control method further comprises:

increasing the amount of heat exchanged between the second heat source and the fluid when an ambient temperature of an environment of the heat exchange device is decreased.

14. The defrosting control method according to claim 11, wherein the operation parameter of the compressor comprises at least one of a discharge pressure of the compressor of the first heat source and an electrical parameter of the compressor of the first heat source, further comprising adjusting the amount of heat exchanged between the second heat source and the fluid when (i) the discharge pressure of the compressor is greater than a preset discharge pressure or (ii) the electrical parameter is greater than a preset electrical parameter.

15. A heating system comprising a central controller, a first heat source, a second heat source, and a heat exchange device which is communicable with the first heat source through a pipeline, wherein the first and second heat sources are communicable with the central controller, wherein the central controller is configured to perform a defrosting control method, the method comprising steps of:

heating a fluid in a flow passage, the flow passage extending between an inlet and an outlet of the first heat source, the heating provided by the second heat source and provided at least in part to defrost the first heat source;

acquiring a value of an operation parameter of the first heat source, wherein the operation parameter comprises at least one selected from the group consisting of a water outlet temperature, a water return temperature, and an operation parameter of a compressor of the first heat source;

comparing the acquired value of the operation parameter with a preset range of the operation parameter;

determining that the acquired value is within the preset range; and adjusting an amount of heat exchanged between the second heat source and the fluid in response to determining the acquired value is within the preset range, wherein the pipeline comprises a water inlet pipeline disposed between the outlet of the first heat source and the heat exchange device, wherein the pipeline further comprises a water return pipeline disposed between the heat exchange device and the inlet of the first heat source, and wherein the second heat source is configured to increase a temperature of fluid in the water inlet pipeline or the water return pipeline.

16. The heating system according to claim 15, wherein the heat exchange device is disposed in the water inlet pipeline or the water return pipeline, and wherein the water supplied by the second heat source exchanges heat with water in the pipeline through the heat exchange device.

17. The heating system according to claim 16, wherein the heat exchange device comprises a plate heat exchanger or a water mixing device.

18. The heating system according to claim 17, wherein the first heat source is an air conditioner or a heat pump, and the second heat source is a gas combustion device or an electric heating device.

19. The heating system according to claim 15, wherein the central controller is further configured to start the second heat source before the first heat source enters a defrosting mode.

20. The heating system according to claim 15, wherein the central controller is further configured to, after the second heat source is started, control a water supply temperature of the second heat source to be less than a set water supply temperature of the first heat source, determine that the water supply temperature of the first heat source is not less than the set water supply temperature of the first heat source, and in response, shut down the first heat source.

* * * * *